US006194673B1

(12) United States Patent
Sato et al.

(10) Patent No.: US 6,194,673 B1
(45) Date of Patent: Feb. 27, 2001

(54) ROTARY ENCODER

(75) Inventors: Jun Sato, Okayama; Hiroshi Matsui, Osaka, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/467,813

(22) Filed: Dec. 20, 1999

(51) Int. Cl.[7] ..... H01H 9/00
(52) U.S. Cl. ..... 200/4; 200/11 R
(58) Field of Search ..... 200/11 D, 11 DA, 200/11 G, 4, 11 R, 19.12, 19.18

(56) References Cited

U.S. PATENT DOCUMENTS

| | | | | |
|---|---|---|---|---|
| 5,204,502 | | 4/1993 | Ferris et al. . | |
| 5,705,778 | * | 1/1998 | Matsui et al. | 200/11 R |
| 5,847,335 | * | 12/1998 | Sugahara et al. | 200/4 |
| 5,894,118 | | 4/1999 | Nishimoto et al. . | |
| 5,952,628 | * | 9/1999 | Sato et al. | 200/4 |

* cited by examiner

*Primary Examiner*—Michael L. Gellner
*Assistant Examiner*—Nhung Nguyen
(74) *Attorney, Agent, or Firm*—Ratner & Prestia

(57) ABSTRACT

A rotary encoder used mainly in a peripheral apparatus for computers, a portable telephone, an on-board electronic device for automobiles, and the like, in which an encoder unit and a linearly-driven type component are operable by a rotating manipulation and a tilting manipulation of an operating axle. The rotary encoder provides accuracy and is capable of producing a large number of output signals without requiring an increase in external dimensions. The rotary encoder is so constructed that flexible contacts and make resilient contact with movable contacts on a peripheral surface of a cylindrical rotor in a main unit of the encoder. The operating axle is pivotally supported by fitting it in an axle-supporting portion of the rotor in a manner that the operating axle is rotatable together with the rotor and is also tiltable. A cylindrical operating knob is attached to the operating axle that protrudes sideways from the rotor, and a push switch is disposed in a position to be in contact with a distal end of the same operating axle, and thereby making the main unit of the encoder operable by rotating manipulation and the push switch by tilting manipulation of the operating axle.

24 Claims, 9 Drawing Sheets

ROTARY ENCODER

FIELD OF THE INVENTION

The present invention relates to a rotary encoder for use mainly in peripheral apparatuses such as a mouse for a computer, portable telephones, on-board electronic devices for automobiles, and the like.

BACKGROUND OF THE INVENTION

A rotary encoder of the prior art has a structure where a movable contact and a stationary contact are disposed on a plane orthogonal to an axis of rotation of the movable contact, and an operating axle is mounted in a position coaxial with the axis of rotation of the movable contact, so that the operating axle is movable only in a direction of the rotation of the axis of rotation, or in the direction of rotation and a direction of the axis.

A rotary encoder equipped with a push switch will be described hereinafter, by referring to FIG. 13, which depicts a partial sectional front view and is representative of a conventional rotary encoder of this kind.

In FIG. 13, an operating axle 31 is inserted into a circular hole 32A of a bearing 32 from underneath it, and a center circular portion 31A is held fitted in the circular hole 32A in a manner that the operating axle 31 is rotatable as well as vertically movable. A thin non-circular spindle 31B at a lower end of the operating axle 31 fits into a non-circular hole 33A in a center of a rotary contact board 33 in such a manner that a rotary movement of the operating axle 31 is transferred to the rotary contact board 33 whereas a vertical movement is not.

The rotary contact board 33 stays in its vertical position by being held between the bearing 32 and a case 34 beneath the rotary contact board 33. The rotary contact board 33 is provided on its lower surface with a contact plate 35 by an insert molding. The contact plate 35 includes a center ring portion 35A and a plurality of rectangular web portions 35B extending radially from the center ring portion 35A, as shown in FIG. 14.

Three flexible contacts 36A, 36B and 36C, all serving as stationary contacts, extending from the case 34 stay in resilient contact with the center ring portion 35A and the rectangular web portions 35B of the contact plate 35 respectively, and all of the above elements constitute a contact portion of an encoder unit. The flexible contacts 36B and 36C corresponding to the rectangular web portions 35B are so positioned that they are slightly shifted with each other in a direction of the rotation.

Further, a push switch 37 is disposed under the case 34, and a lower end 31C of the operating axle 31 locates in contact with an upper end of a push button 37A of the push switch 37.

Operation of the rotary encoder equipped with a push switch will now be described hereinafter. When an operating knob 39 attached to an upper end 31D of the operating axle 31 is rotated, it turns the operating axle 31 and therefore the rotary contact board 33. Among the three flexible contacts 36A, 36B and 36C placed against the contact plate 35 on the lower surface of the rotary contact board 33, the flexible contacts 36A slides resiliently on the center ring portion 35A and the flexible contacts 36B and 36C slide on the rectangular web portions 35B. As a result, the rotation generates pulse signals between the terminals 38A and 38B as well as between the terminals 38A and 38C communicating with their respective flexible contacts 36A, 36B and 36C, and thereby they function as an encoder.

In the above operation, a circuit of an apparatus, which employs this device, detects a delay in time between the pulse signals that appear between the terminals 38A and 38B, and between the terminals 38A and 38C, due to the shift in positions of the flexible contacts 36B and 36C, which are in contact with the rectangular web portions 35B of the contact plate 35. And the device is able to function according to a direction and an amount of the rotation.

Also, during the above rotating manipulation, the operating axle 31 does not move in the vertical direction, so as not to operate the push switch 37.

Next, when the operating axle 31 is moved downward by applying a depressing force to the operating knob 39 attached to the upper end 31D of the operating axle 31, as shown by an arrow in FIG. 15, i.e. a partial sectional front view of the device, the lower end 31C depresses the push button 37A to operate the push switch 37.

The encoder unit does not function by this manipulation, because the rotary contact board 33 of the encoder unit does not move downward, nor does it rotate.

However, the rotary encoder of the prior art is operative only in the direction of rotation and the direction of the axis of the operating axle 31 to which the operating knob 39 is attached. To improve accuracy of the encoder unit by increasing the resolution or to increase the number of output signals, it is necessary to increase the number of rectangular web portions 35B extended radially from the center ring portion 35A of the contact plate 35, or increase the number of flexible contacts 36B and 36C, which are so arranged as to make contact with the rectangular web portions 35B at points shifted with respect to each other. For this improvement, it is necessary to increase the width of each of the rectangular web portions 35B and insulation spaces between them. This consequently requires an extension in length of the rectangular web portions 35B toward their radial direction, and therefore an enlargement in diameter of the contact plate 35, i.e. the movable contact. This causes a substantial restriction in designing the apparatuses that employ these devices, since it increases overall dimensions of the rotary encoder, including the case 34. Because of the increased radiuses of the contacting points the sliding speed at the contacting points between the flexible contacts 36B and 36C and the rectangular web portions 35B is increased during rotating manipulation, thus giving rise to a problem that disturbances in the signal, such as fluctuations, are liable to occur at boundaries between the rectangular web portions 35B, i.e. conductive surfaces, and insulating surfaces.

An object of the present invention is to solve the foregoing problem, and to provide a rotary encoder that is capable of operating a linearly-driven type component in addition to a rotary type encoder by rotating and tilting an operating axle provided with an operating knob. The invention also provides a rotary encoder that is more accurate and capable of producing a greater number of output signals without requiring an increase in external dimensions.

SUMMARY OF THE INVENTION

A rotary encoder of the present invention includes, (1) a stationary body provided with a plurality of flexible contacts having their respective terminals for providing signals, (2) a rotor in a cylindrical form made of insulation material, and supported rotatably by the stationary body, the rotor being provided on its peripheral surface with a ring shaped movable contact and comb-tooth shaped movable contacts extending sideways at a predetermined angle pitch from the ring shaped movable contact, with which the plurality of flexible contacts make resilient contact, and the rotor having a non-circular hole in its rotational center, (3) an operating axle fitted in and pivotally supported by the non-circular hole in the center of the rotor in such a manner that it rotates together with the rotor and is also freely tiltable, (4) an operating knob having either a cylindrical shape or a polygonal shape in a predetermined width, and attached to the operating axle protruding from the rotor, and (5) a linearly-driven type component disposed in a manner to be in contact with an outer periphery of the operating axle either at an end portion or an intermediate portion, and operative with a tilting manipulation of the operating axle. The simple structure as described above realizes the rotary encoder, in which the encoder unit is operable by a rotating manipulation of the operating axle provided with the cylindrical operating knob, and the linearly-driven type component is operable by a tilting manipulation of the same operating axle. The structure also realizes a rotary encoder that is more accurate and capable of producing a greater number of output signals without increasing external dimensions.

Also, the rotary encoder has a structure in that the rotor is provided with a hole in its center, and the hole includes a non-circular hole portion formed through a certain thin portion of a width of the rotor, and a clearing portion having a diameter greater than a diameter of the non-circular hole formed through a remaining width portion of the rotor. The operating axle has a uniform cross sectional shape that is substantially identical to a shape of the non-circular hole, wherein the operating axle is fitted and supported by it. This structure provides the rotary encoder with such advantages that operating axles in large quantity can be manufactured easily by simply cutting a length of bar material having a uniform cross-section of non-circular shape, and that operating axles of any length can be prepared readily.

Further, another structure of the rotary encoder is that the non-circular hole in the center of the rotor and cross section of the operating axle that fits into the non-circular hole are made to be substantially regular polygonal in shape. The structure adopting the fitting portion of substantially regular polygonal shape provides an advantage that the operating axle can be tilted smoothly at any rotating angle of the rotor.

In another structure of the rotary encoder, the non-circular hole in the center of the rotor is formed in a shape of substantially regular polygon, and the operating axle is provided at one end thereof with a polygonal sphere having a cross section practically identical to the substantially regular polygonal hole. The spherical end of the operating axle is fitted into the substantially regular polygonal hole. This structure for fitting the polygonal sphere also provides an advantage that the operating axle can be tilted smoothly at any rotating angle of the rotor. In addition, the structure provides an effect of reducing a play angle of the operating axle during rotary manipulation of it, as a diameter of the fitting portion is increased.

Also, the rotary encoder is provided with a self-resetting type push switch as the linearly-driven type component. This structure can easily realize a rotary encoder equipped with a self-resetting type push switch, which is usable very widely for peripheral apparatuses of computers, portable telephones and on-board electronic devices for automobiles.

Also, the rotary encoder has ditches and ridges formed circularly along a peripheral surface of the rotor at the same angle pitch with the comb-tooth shaped movable contacts, and a click spring mounted on the stationary body in a manner that a dowel at a tip of a spring pillar is pressed resiliently against the ditches and ridges. This structure provides a click feeling for a user making a rotary manipulation of the operating axle. The structure also prevents the operating axle from being rotated inadvertently when making a tilting manipulation of the operating axle.

Further, the rotary encoder is so constructed that two flexible contacts among the plurality of flexible contacts make resilient contact with the comb-tooth shaped movable contacts on the peripheral surface of the rotor, and two contacting points between the flexible contacts and the comb-tooth shaped movable contacts are shifted with respect to each other in a direction of rotation. This structure provides an advantage of allowing detection of a rotating direction of the rotary encoder according to a phase difference between pulse signals generated from the two flexible contacts.

Moreover, the rotary encoder is so constructed that the flexible contacts remain in an OFF position between two of the comb-tooth shaped movable contacts, when the dowel at the tip end of the spring pillar rests in a ditch among the circularly formed plurality of ditches and ridges on the peripheral surface of the rotor. The structure has an advantage of realizing an encoder unit that is not liable to generate an erroneous signal due to a malfunction during a tilting manipulation of the operating axle, and that the encoder unit does not consume any current while not being operated.

In addition, the rotary encoder has a structure in that the plurality of flexible contacts are arranged to make resilient contact with the movable contacts on the periphery of the rotor at a surface generally orthogonal to a mounting surface that is in parallel with an axis of the rotation of the rotary encoder. The structure thus provides an advantage of further reducing a height of the rotary encoder.

DESCRIPTION OF THE PREFERRED EMBODIMENTS

Preferred exemplary embodiments of the present invention will be described hereinafter by referring to the accompanying figures.

First Exemplary Embodiment

Figure 1:
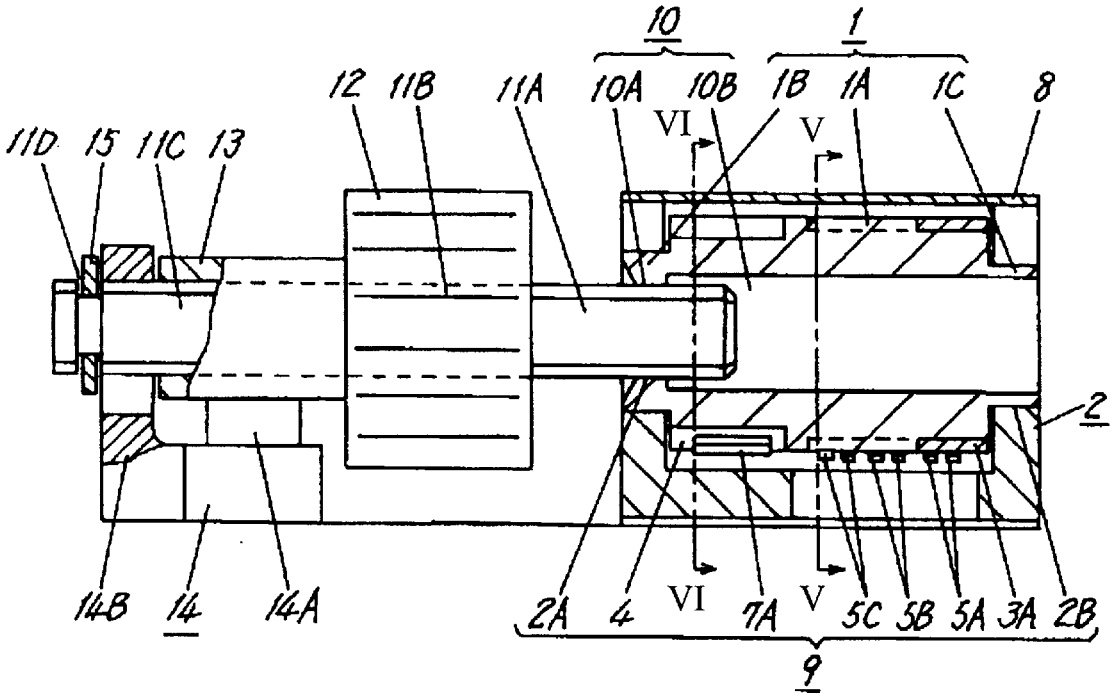
FIG. 1 is a partially sectioned side view depicting a rotary encoder of a first exemplary embodiment of the present invention.
Figure 2:
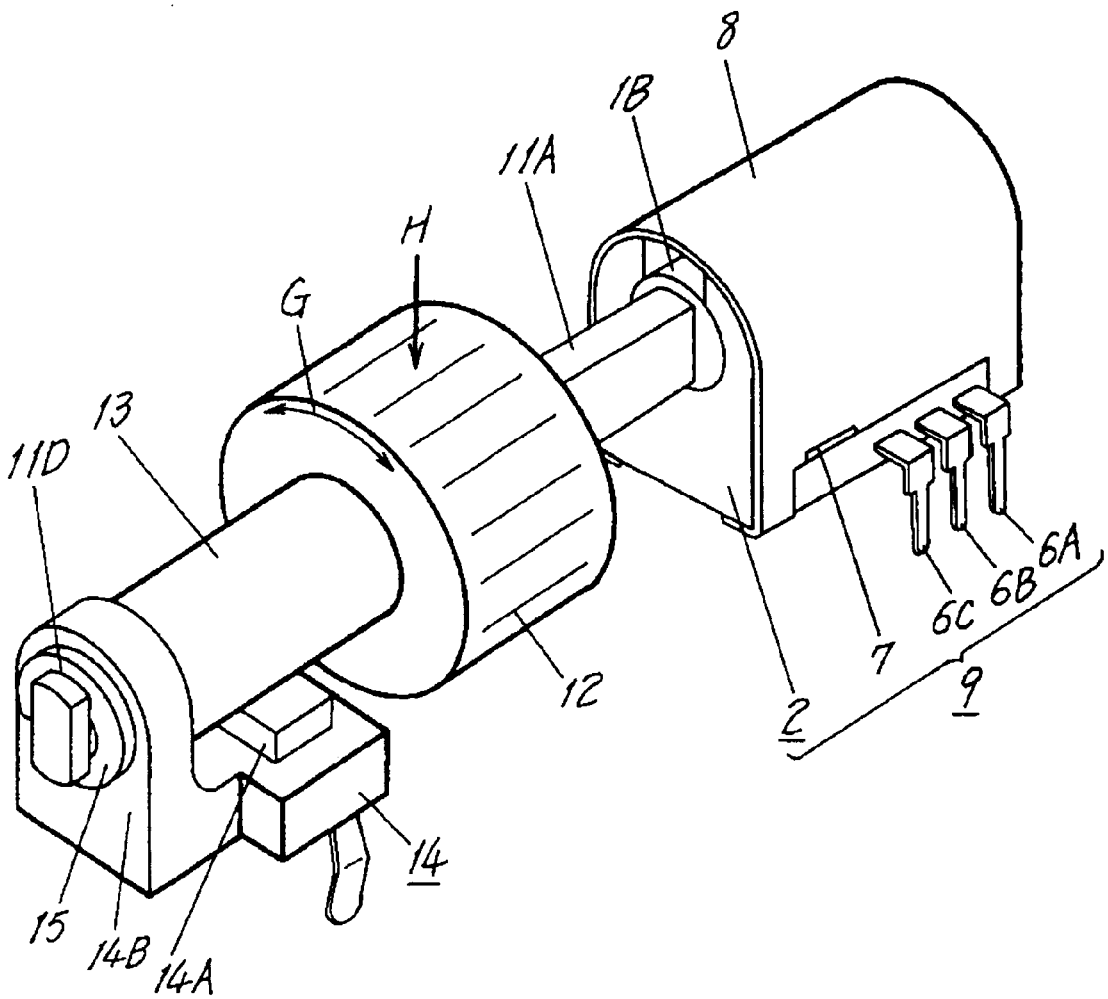
FIG. 2 is a general perspective view of the same rotary encoder.

FIG. 1 is a partially sectioned side view depicting a rotary encoder of a first exemplary embodiment of the present invention. FIG. 2 is a general perspective view and FIG. 3 is an exploded perspective view of the same rotary encoder.

Figure 3:
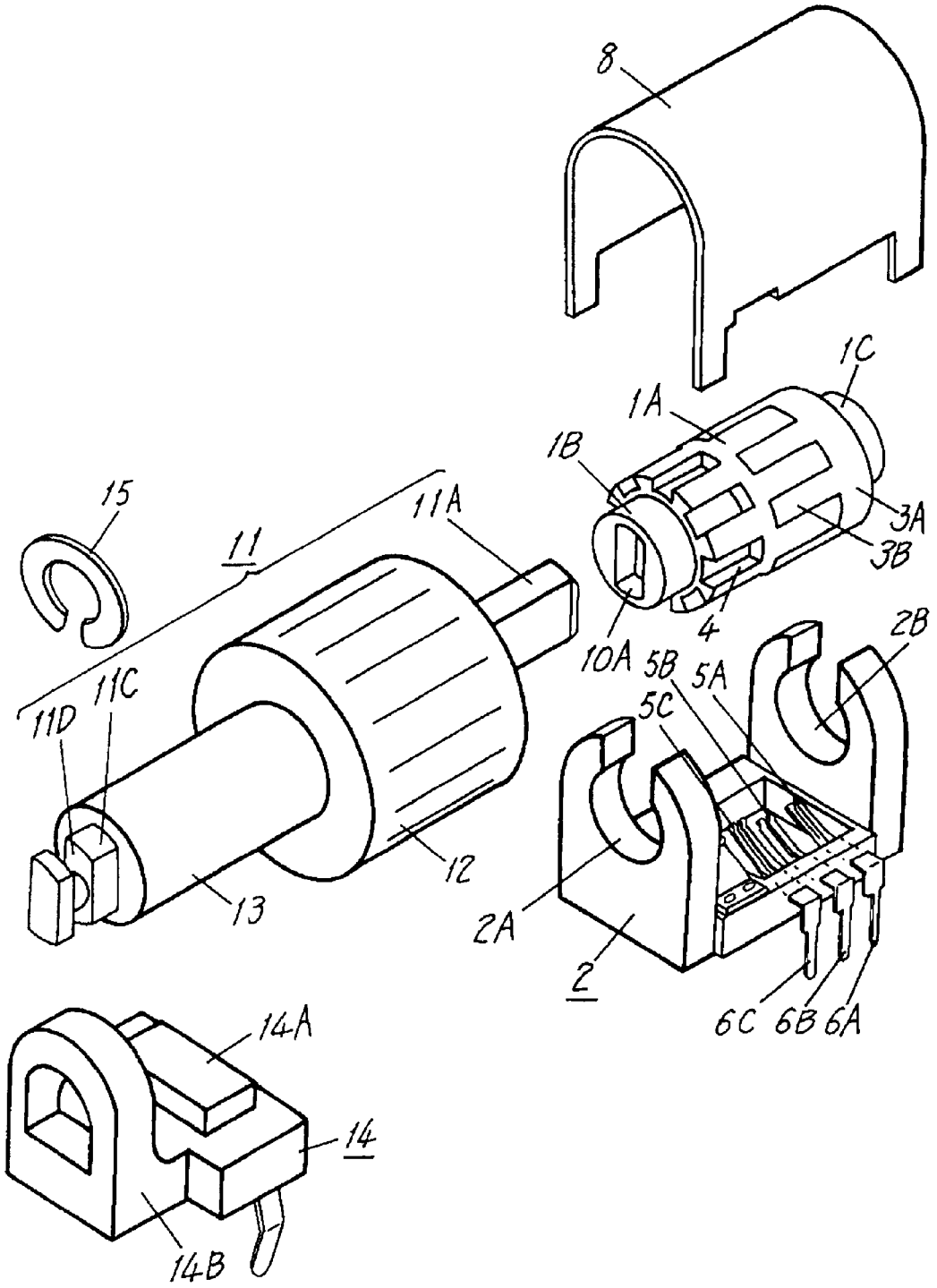
FIG. 3 is an exploded perspective view of the same rotary encoder.

As shown in FIG. 1 through FIG. 3, a cylindrically formed rotor 1 made of insulation resin is constructed in a shape having a major cylindrical body 1A in its center portion and minor cylindrical portions lB and 1C concentrically formed at both ends thereof. The rotor 1 is supported rotatably by press-fitting the minor cylindrical portions 1B and 1C at its both ends through an opening on top of a stationary body 2 made of insulation resin into bearing holes 2A and 2B at both ends of the stationary body 2. The major cylindrical body 1A is provided on a backside of its peripheral surface with a ring shaped movable contact 3A around an entire periphery in a shape of belt, and comb-tooth shaped movable contacts 3B extending sideways from the ring shaped movable contact 3A at a predetermined angle pitch. The major cylindrical body 1A is also provided on a front side of it with ditches and ridges 4 around the entire periphery at the same angle pitch with the comb-tooth shaped movable contacts 3B.

Figure 4:
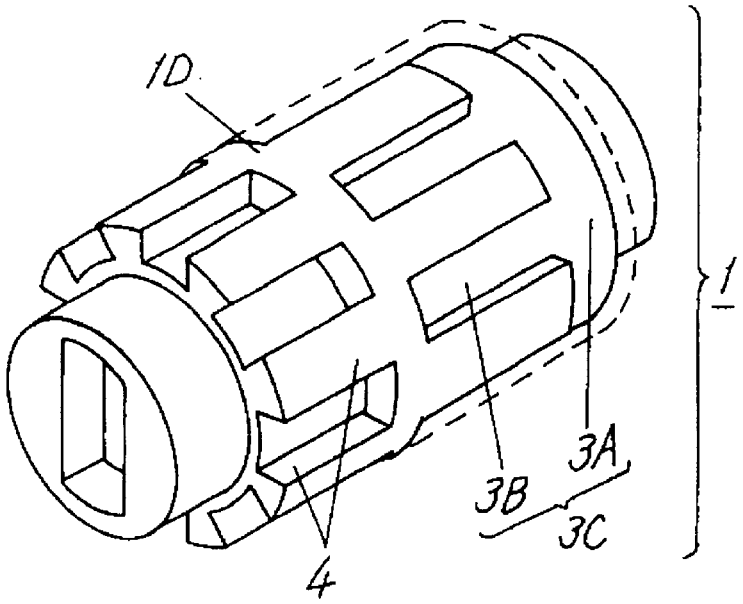
FIG. 4 is a general perspective view depicting a method of forming a rotor of the same rotary encoder.

The rotor 1 having the ring shaped movable contact 3A, the comb-tooth shaped movable contacts 3B, and the ditches and ridges 4 is produced by a two-step molding including a first step of forming a rotor's main body ID, which has a recessed portion 3C for the ring shaped movable contact 3A and the comb-tooth shaped movable contacts 3B as shown in FIG. 4, with insulation resin, followed by a second step of injection-forming conductive resin (shown by a dotted line) into the recessed portion 3C.

Figure 5:
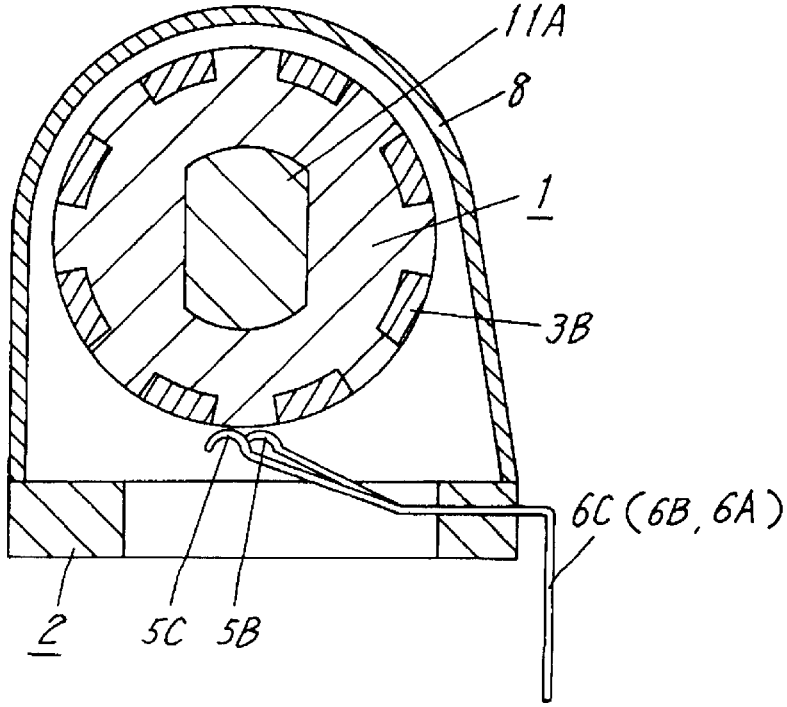
FIG. 5 is a sectional view taken along a line E—E shown in the same rotary encoder of FIG. 1.
Figure 6:
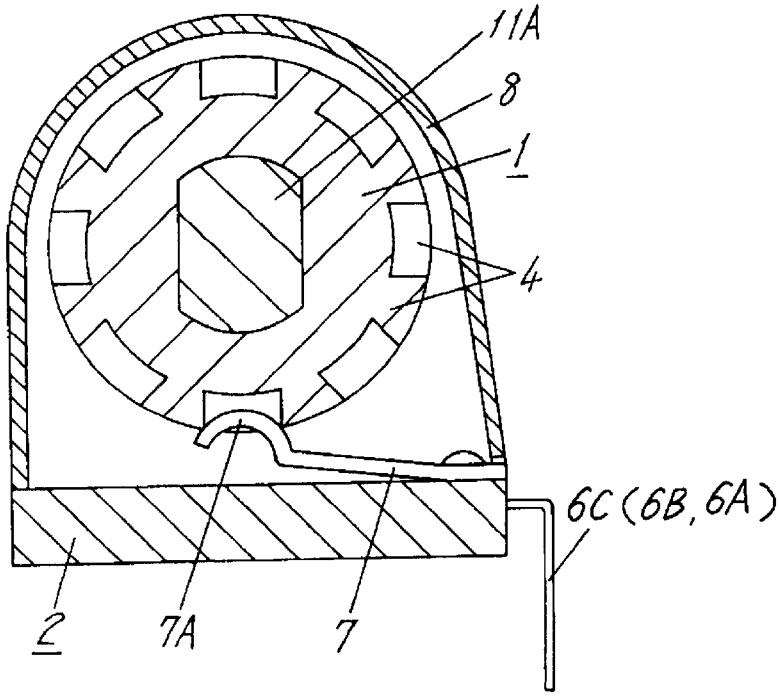
FIG. 6 is a sectional view taken along a line F—F shown in the same rotary encoder of FIG. 1.

The stationary body 2 is insert-molded at its back center location to support flexible contacts 5A, 5B and 5C made of electrically conductive material connecting to their respective terminals 6A, 6B and 6C for leading signals. These terminals 6A, 6B and 6C protrude from a lower surface of the stationary body 2, where it is mounted on a wiring board of an apparatus employing this rotary encoder. The flexible contact 5A, and the flexible contacts 5B and SC stay resiliently in contact with the ring shaped movable contact 3A and the comb-tooth shaped movable contacts 3B respectively on the periphery of the rotor 1 from underside thereof, as shown in FIG. 5. A spring pillar 7 made of thin flexible sheet metal is riveted to a front center location of the stationary body 2, and a dowel 7A at a tip of the spring pillar 7 is resiliently in contact with the ditches and ridges 4 provided on the outer periphery of the rotor 1, as shown in FIG. 6.

Figure 7:
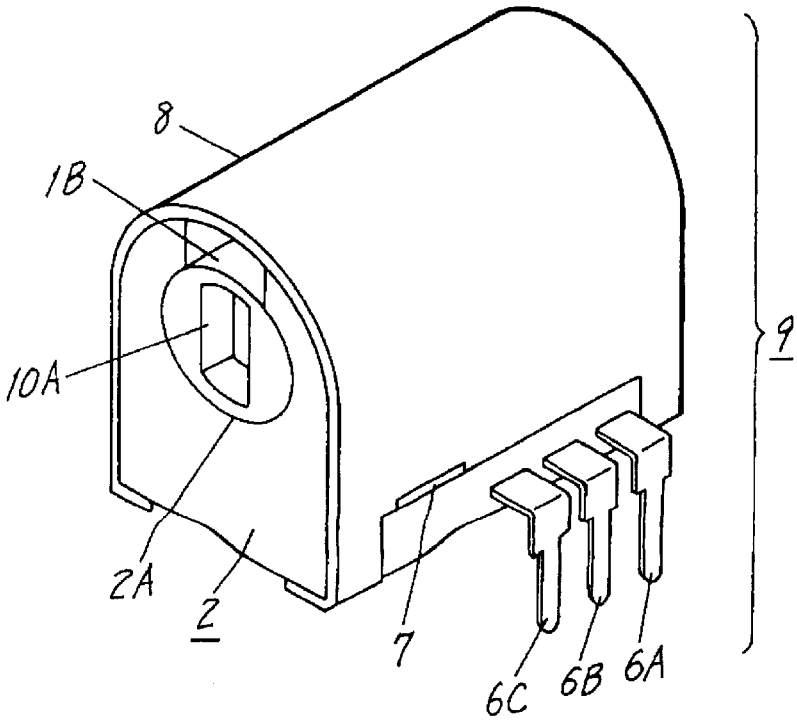
FIG. 7 is a general perspective view depicting a main unit of the same rotary encoder.

A main unit 9 of the encoder, shown in FIG. 7, is completed when a protective cover 8 is placed over the stationary body 2, which is assembled together with the cylindrical rotor 1 as described above.

The two flexible contacts 5B and SC are so arranged that positions where they make resilient contact with the comb-tooth shaped movable contacts 3B are slightly shifted with respect to each other in a direction of rotation of the cylindrical rotor 1. The flexible contacts 5B and SC are also arranged in a manner that both of them are in an OFF position, i.e. in contact with an insulating surface between the comb-tooth shaped movable contacts 3B extending from the ring shaped movable contact 3A,when the dowel 7A rests in a ditch among the ditches and ridges 4.

The rotor 1 in the main unit 9 of the encoder is provided in a center thereof with a hole 10, which has an axle supporting portion 10A of a small diameter having a shape of parallel-sided ellipse in a thin portion at a front side and a clearing portion 10B at a back side of the rotor 1 having a diameter greater than that of the axle supporting portion 10A. A back end portion 11A of an operating axle 11 having a cross sectional shape generally similar to the axle supporting portion 10A is inserted in and pivotally supported by the axle supporting portion 10A in a manner that the operating axle 11 is rotatable together with the rotor 1 as well as tiltable.

A cylindrical operating knob 12 is attached to a center portion 11B of the operating axle 11 protruding forward from the rotor 1, and a sleeve 13 is fitted on a tip end portion 11C of the same. An outer surface of the sleeve 13 is in contact with a top surface of a push button 14A of a self-resetting type push switch 14. The operating axle 11 is restricted of its movement by an axle retaining portion 14B, which is an integral part of a case of the push switch 14, so that the tip end portion 11C of it moves only in a downward direction, but not in horizontal and upward directions. Furthermore, the operating axle 11 is held in position by inserting a washer 15 in a groove 11D near the tip end that projects from the axle retaining portion 14B so that the operating axle 11 does not come out of the axle retaining portion 14B.

The operating axles 11 can be manufactured easily in large quantity by simply cutting a length of bar material having a uniform cross-sectional shape of parallel-sided ellipse and the operating axles of any length can be prepared readily.

The rotary encoder of the present exemplary embodiment constructed as above operates in a manner, which will be described hereinafter.

First, when the cylindrical operating knob 12 attached to the center portion 11B of the operating axle 11 is rotated by a force applied to an outer surface thereof in a tangential direction as shown by an arrow G in FIG. 2, the rotor 1 rotates, as it is supported rotatably in the bearing holes 2A and 2B of the stationary body 2. When the rotor 1 rotates, the dowel 7A at the tip of the spring pillar 7, previously fitted in one of the ditches amongst the ditches and ridges 4 around the major cylindrical body 1A of the rotor 1, comes out of the ditch, slides resiliently over the ditches and ridges 4 while producing click feeling to an operator, and fits into another ditch in a new rest position.

Figure 8:
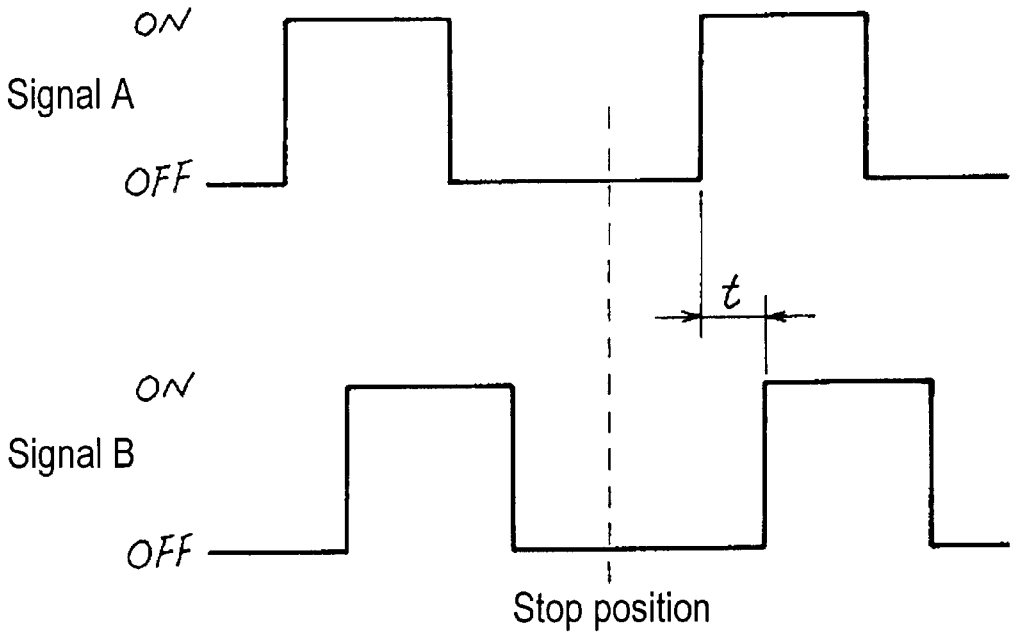
FIG. 8 depicts waveforms of pulse signals generated by the same rotary encoder.

At the same time, the flexible contacts 5A, 5B and 5C slide resiliently on a surface of the ring shaped movable contact 3A and the comb-tooth shaped movable contacts 3B located backward of the ditches and ridges 4, and generate pulse signals between the terminals 6A and 6B, as well as the terminals 6A and 6C amongst the three terminals 6A, 6B and 6C connected to their respective flexible contacts 5A, 5B and 5C, in the same manner as in the case of the prior art encoder. During the above operation, a phase difference "t" occurs between a pulse signal (signal "A") generated between the terminals 6A and 6B, and another pulse signal (signal "B") generated between the terminals 6A and 6C, as shown by waveforms in FIG. 8, due to the shift in positions of the flexible contacts 5B and 5C, which are both in contact with the comb-tooth shaped movable contacts 3B. A circuit of an apparatus equipped with this rotary encoder detects this phase difference "t", and operates accordingly.

During this movement, the rotary encoder does not consume a current except for a moment when the rotor is in rotary movement, since the two flexible contacts 5B and 5C start the sliding movement from their OFF position between two extending portions of the comb-tooth shaped movable contacts 3B, and stop the movement again at a new OFF position.

Also, sliding speeds of the flexible contacts 5A, 5B and 5C are all equal at their contacting points with the movable contacts during the above rotary movement, because radiuses of rotation of the contacting points, where the flexible contacts 5A, 5B and 5C slide resiliently, are equal to a radius of the rotor 1, as is obvious from FIG. 1 and FIG. 3. The same is true, even if a number of the flexible contacts such as 5A and 5B, making resilient contact with the comb-tooth shaped movable contacts 3B, is increased. Accordingly, this structure allows a reduction in overall height of the rotary encoder by minimizing a diameter of the rotor 1, and also realizes a rotary encoder not liable to generate disturbances in the signal, such as fluctuations, that can occur at boundaries between the comb-tooth shaped movable contacts 3B, i.e. conductive surfaces, and insulating surfaces.

The same advantage also applies even if a number of the comb-tooth shaped movable contacts 3B is increased in order to improve resolution of the encoder.

During the above rotary movement, the operating axle 11 does not tilt downward and the push switch 14 remains not operative, since the tip end portion 11C of the operating axle 11 is forced to stay in the upper position with a spring tension of the push button 14A of the push switch 14.

Figure 9:
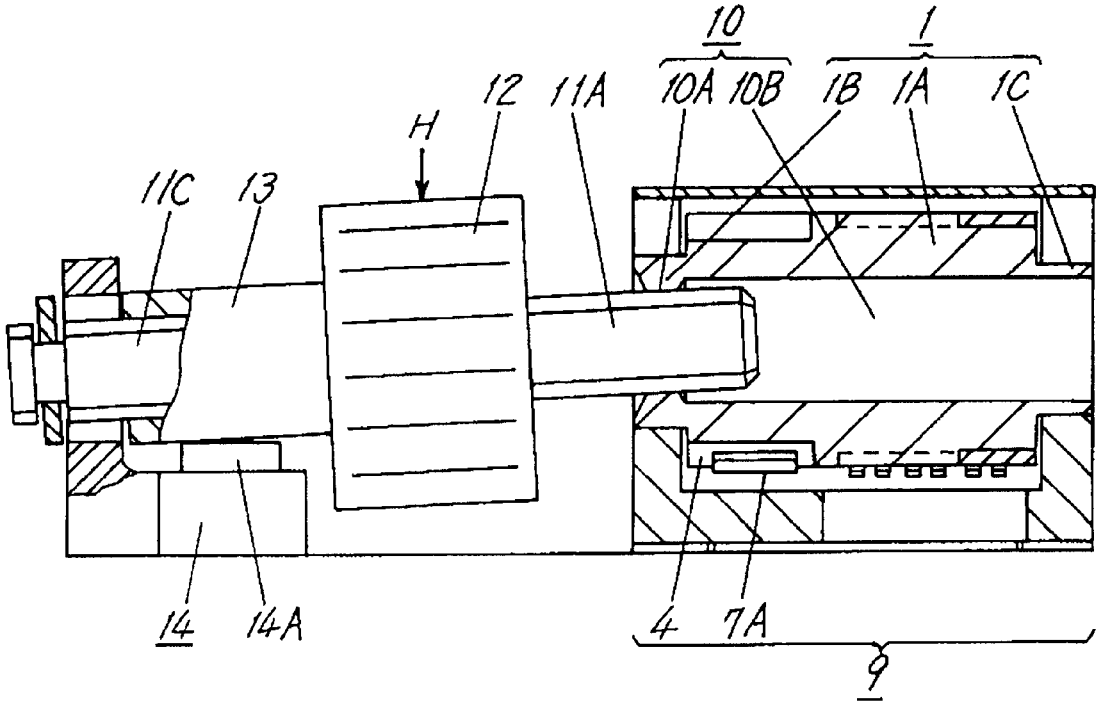
FIG. 9 is a partially sectioned side view depicting the same rotary encoder in a state that a push switch is operated.

Next, when a top of the cylindrical operating knob 12 in its normal position shown in FIG. 1 is given a depressing force against the spring tension of the push switch 14 as shown by an arrow "H" in a perspective view of FIG. 2 or a partially sectional side view of FIG. 9, the operating axle 11 tilts in such a position that the tip end portion 11C moves downward while the axle supporting portion 10A of the hole 10 in the center of the rotor 1 of the main unit 9 of encoder functions as a fulcrum. This causes the sleeve 13 at the tip end portion 11C to depress the push button 14A of the push switch 14, which is in contact with a lower surface of the sleeve 13, and to operate the push switch 14. The operating axle 11 and the cylindrical operating knob 12 are pushed back upward by the spring tension of the push switch 14, and return to their original positions as shown in FIG. 1, when the depressing force is removed from the cylindrical operating knob 12.

The main unit 9 of the encoder does not make a rotating operation during this manipulation of depressing the cylindrical operating knob 12 and tilting the operating axle 11, because the rotor 1 does not rotate, since the dowel 7A at the tip of the spring pillar 7 remains in a ditch among the ditches and ridges 4 on the outer periphery of the major cylindrical body 1A of the rotor 1 of the main unit 9 of the encoder.

Also, because the two flexible contacts 5B and 5C stay in the OFF position between two extending portions of the comb-tooth shaped movable contacts 3B, they do not generate an erroneous signal functioning as an encoder during this movement.

As described above, the present exemplary embodiment realizes a rotary encoder equipped with a push switch that is adaptable for a variety of applications, since the main unit 9 of the encoder is operable by a rotating manipulation of the cylindrical operating knob 12 attached to the operating axle 11, and the push switch 14 is operable by a tilting manipulation of the operating axle 11 by depressing an outer surface of the same operating knob 12 in a direction orthogonal to its axis.

Figure 10:
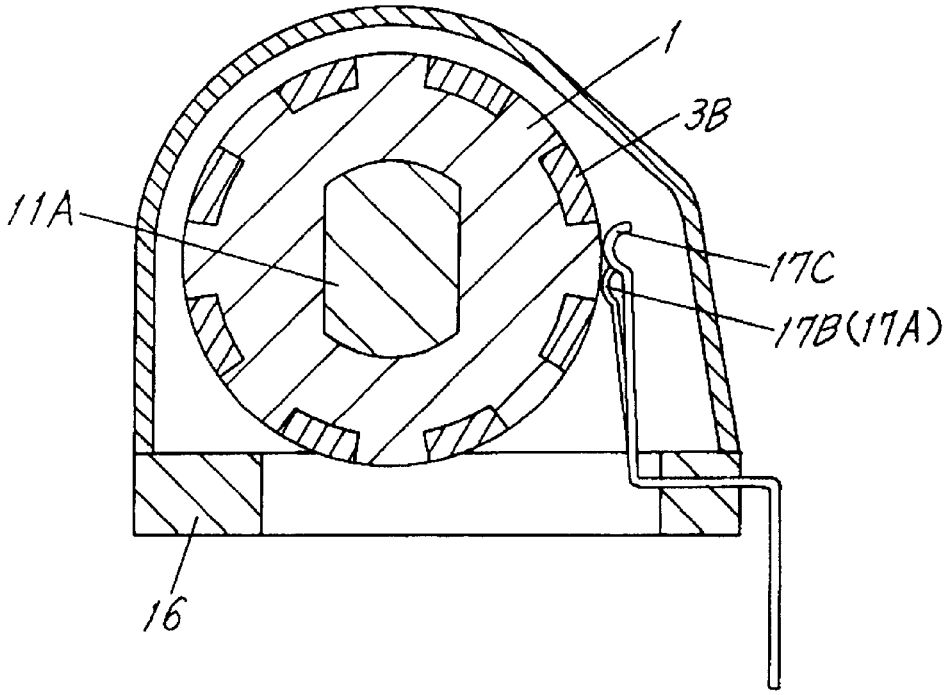
FIG. 10 is a cross-sectional view of the same rotary encoder, depicting another structure, in which positions for flexible contacts and a spring pillar to make resilient contact are altered.

The foregoing exemplary embodiment is an example, in which the flexible contacts 5A, 5B and 5C held by insert-molding in the stationary body 2 and the spring pillar 7 riveted to the same stationary body 2 are resiliently in contact with the ring shaped movable contact 3A, the comb-tooth shaped movable contacts 3B, and the ditches and ridges 4 provided on the outer periphery of the cylindrical rotor 1 from the underside thereof. However, this structure may be altered as shown in FIG. 10, where flexible contacts 17A, 17B and 17C and the spring pillar 7 (not shown in the figure) make resilient contact with the side surface of the cylindrical rotor 1, i.e. a position generally orthogonal to a mounting surface under a stationary body 16, and thereby an overall height of the rotary encoder can be further reduced.

Figure 11:
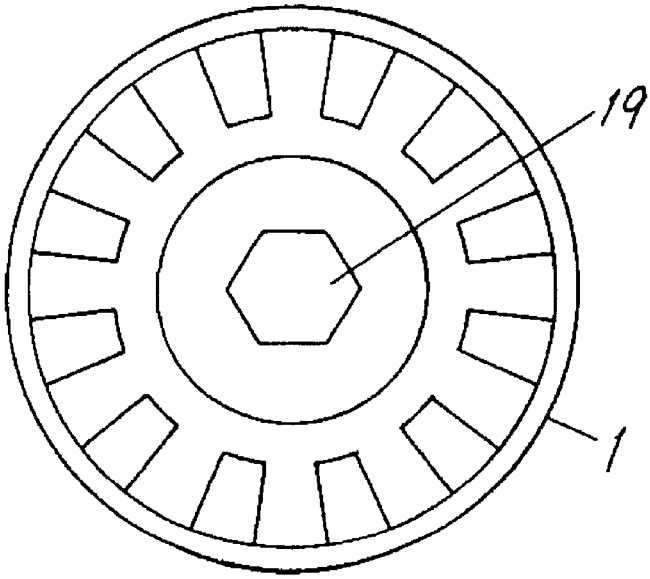
FIG. 11 is a front view depicting another structure of the rotor.

Also, the foregoing exemplary embodiment is an example, in which the axle-supporting portion 10A of the hole 10 in the center of the rotor 1 and a cross section of the back end portion 11A of the operating axle 11 that fits in the axle-supporting portion 10A are both in the same shape of a parallel-sided ellipse. However, a tilting manipulation of the operating axle 11 can be made more smoothly at any angle of rotating position of the rotor 1, if the axle-supporting portion 10A and the operating axle 11 are formed preferably into a regular polygonal shape like a regular hexagonal hole 19 as shown in a front view of another rotor in FIG. 11.

Further, the exemplary embodiment described above is an example, in which the main unit 9 of the encoder, the push switch 14 and the cylindrical operating knob 12 for manipulating both of them, are arranged such that the cylindrical operating knob 12 is disposed between the main unit 9 of the encoder and the push switch 14, as shown in FIG. 1 and FIG. 2. However, the structure can be altered so that the push switch 14 is arranged in a position between the main unit 9 of the encoder and the cylindrical operating knob 12, depending on convenience in the apparatus employing the rotary encoder. If such is the case, this structure can increase the depressing stroke of the cylindrical operating knob 12, when depressing the cylindrical operating knob 12 to tilt the operating axle 11.

Second Exemplary Embodiment

Figure 12:
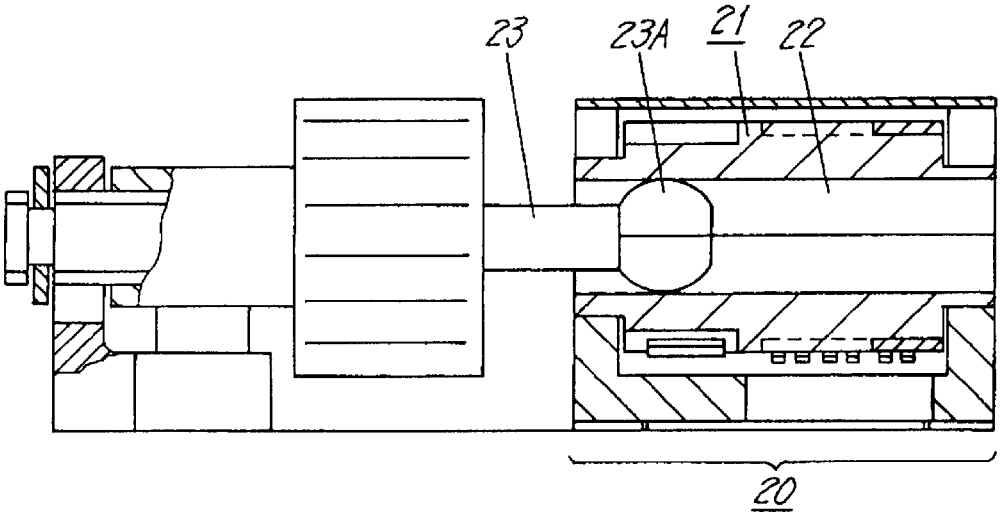
FIG. 12 is a partially sectioned side view depicting a rotary encoder of a second exemplary embodiment of the present invention.
Figure 13:
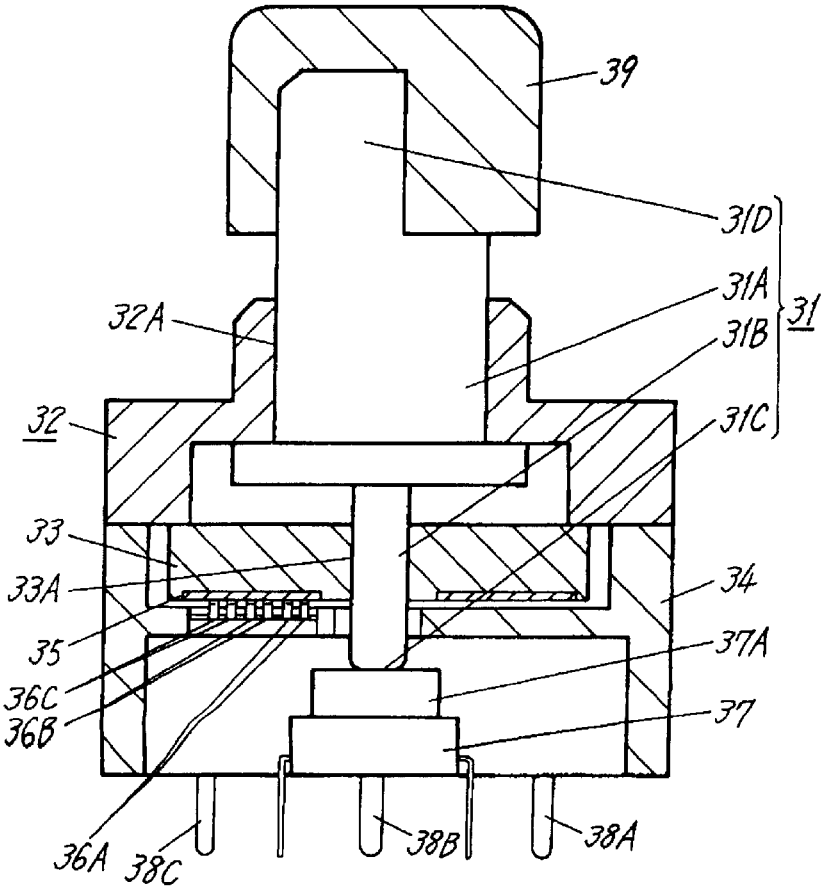
FIG. 13 PRIOR ART
FIG. 13 is a partially sectional front view depicting a rotary encoder of the prior art.
Figure 14:
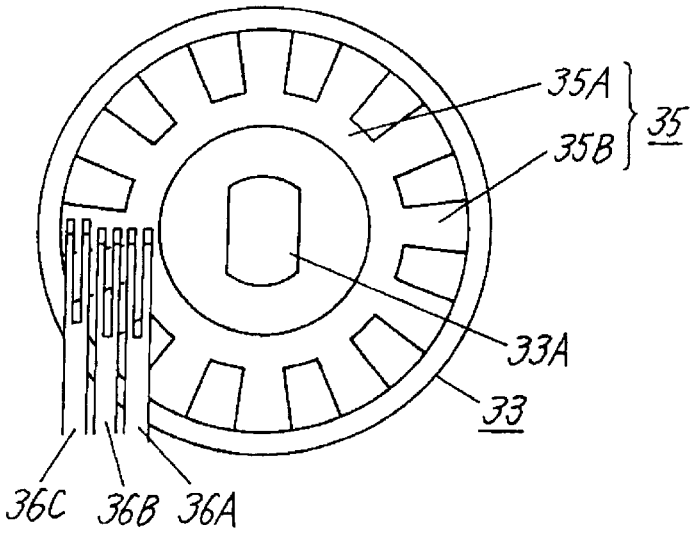
FIG. 14 PRIOR ART
FIG. 14 is a plan view depicting a lower surface of a rotary contact board of the same rotary encoder.
Figure 15:
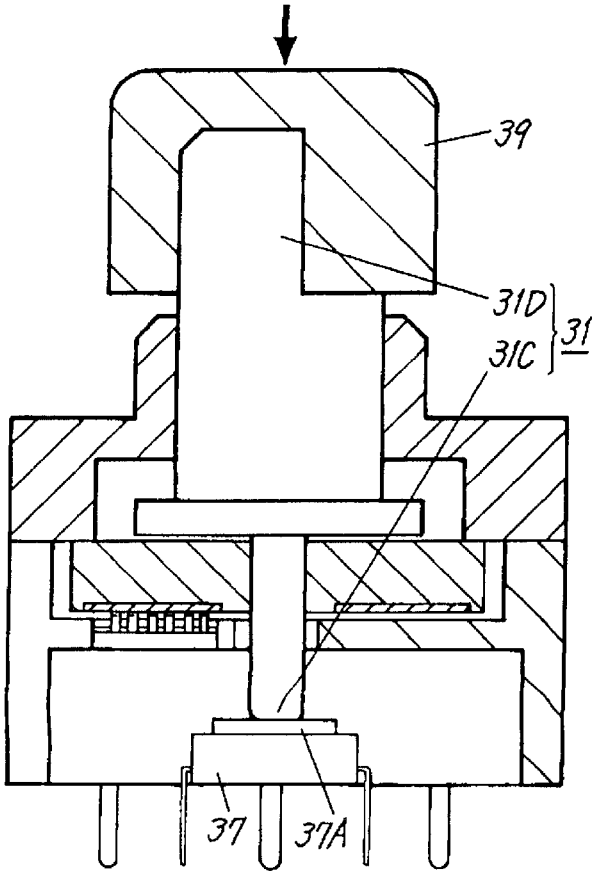
FIG. 15 PRIOR ART
FIG. 15 is a partially sectional front view depicting the same rotary encoder in a state that an operating axle is depressed.

FIG. 12 is a partial sectional side view depicting a rotary encoder of a second exemplary embodiment of the present invention. The rotary encoder of this exemplary embodiment differs in the shape of a hole 22 in the center of a rotor 21 of a main unit 20 of the encoder as well as an operating axle 23 fitting therein, as compared to those of the above-described first exemplary embodiment.

That is, the hole 22 in the center of the rotor 21 is preferably uniformly bored in the shape of a regular hexagon, and fitted therein is a regular hexagonal sphere 23A having a cross-section a regular hexagon at one end of the operating axle 23 the structure of other components of the present rotary encoder is identical to that of the first exemplary embodiment.

Details of the rotary encoder of this exemplary embodiment will not be described, since it operates exactly in the same manner as that of the first exemplary embodiment.

According to the structure of this exemplary embodiment, the operating axle 23 can be manipulated more smoothly at any angle of the rotating position of the rotor 21 as compared to that of the first exemplary embodiment. The structure can also reduce the play angle of the operating axle 23, since the diameter of the hole 22 in the center of the rotor 21 and the diameter of the regular hexagonal sphere 23A at the end of the operating axle 23 fitted therein can be increased.

The hole 22 in the center of the rotor 21 and the regular hexagonal sphere 23A at the end of the operating axle 23 to be fitted therein need not be restricted to the regular hexagonal shape, but they can be of any regular polygon shape such as octagon or dodecagon, as a matter of course.

Although the operating knob has been described specifically as having a cylindrical shape in the above exemplary embodiments of the invention, it may be of any other shape such as a polygonal shape having a certain width, besides the cylindrical shape with a certain width, in order to gain the same function and effect as stated above.

Although what has been described in the present invention is one example employing a push switch, it need not be restrictive to the push switch, and any kind of linearly-drive type components may be employed.

As has been described, the present invention can realize a rotary encoder, in which an encoder unit is operable by a rotating manipulation of a cylindrical operating knob attached to an operating axle, and a linearly-driven type component is operable by a tilting manipulation of the operating axle by depressing an outer surface of the cylindrical operating knob in a direction orthogonal to its rotary axis. In addition, the invention can realize a rotary encoder that is more accurate and capable of producing a greater number of output signals, yet not liable to generate disturbances in the signal, without increasing its outer dimension.

What is claimed is:

1. A rotary encoder comprising:

(1) a stationary body provided with a plurality of flexible contacts having respective terminals thereof for providing signals;

(2) a rotor in a cylindrical shape made of insulation material, and supported rotatably by said stationary body, said rotor being provided on a peripheral surface thereof with a ring shaped movable contact and comb-tooth shaped movable contacts extending sideways at a predetermined angle pitch from said ring shaped movable contact, with which said plurality of flexible contacts make resilient contact, and said rotor having a non-circular hole in a rotational center thereof;

(3) an operating axle fitted in and pivotally supported by said non-circular hole in the center of said rotor in a manner that said operating axle rotates together with said rotor and is also freely tiltable;

(4) an operating knob having one of a cylindrical shape and a polygonal shape in a predetermined width, and attached to said operating axle protruding from said rotor; and (5) a linearly-driven type component disposed in a manner to be in contact with an outer periphery of said operating axle at one of an end portion and an intermediate portion, and being operative with a tilting manipulation of said operating axle.

2. The rotary encoder of claim 1, wherein:

said non-circular hole in a rotational center comprises a first non-circular hole portion formed through an end of said rotor and having a width less than a second hole portion, said second non-circular hole portion having a diameter greater than a diameter of said first non-circular hole portion and formed through a remaining width portion of said rotor; and said operating axle has a cross sectional shape that is substantially identical to a shape of said first non-circular hole portion.

3. The rotary encoder of claim 2, wherein said non-circular hole portion in the rotational center of said rotor and a cross section of said operating axle to be fitted into said non-circular hole portion are substantially polygonal in shape.

4. The rotary encoder of claim 1, wherein:

said non-circular hole in the center of said rotor is substantially polygonal in shape, and;

said operating axle is provided at one end thereof with a substantially polyhedron for being fitted into said substantially polygonal hole.

5. The rotary encoder of claim 1, wherein said linearly-driven type component comprises a self-resetting type push switch.

6. The rotary encoder of claim 1, wherein:

said rotor has a plurality of ditches and ridges formed circularly along a peripheral surface thereof at substantially the same angle pitch with said comb-tooth shaped movable contacts; and said stationary body has a click spring, of which a dowel at a tip of a spring pillar is pressed resiliently against said ditches and ridges.

7. The rotary encoder of claim 1, wherein:

two out of said plurality of flexible contacts make resilient contact whit said comb-tooth shaped movable contacts on the peripheral surface of said rotor; and contacting points between said two flexible contacts and said comb-tooth shaped movable contacts are shifted with respect to each other in a direction of rotation.

8. The rotary encoder of claim 7, wherein said two flexible contacts are arranged in a manner that said two flexible contacts remain in an OFF position on said comb-tooth shaped movable contacts, when said dowel at the tip end of said spring pillar rests in a ditch among said circularly formed plurality of ditches and ridges on the peripheral surface of said rotor.

9. The rotary encoder of claim 1, wherein said plurality of flexible contacts are arranged to make resilient contact with said movable contacts on the periphery of said rotor at a surface substantially orthogonal to a mounting surface of said rotary encoder, said mounting surface being in parallel with an axis of rotation.

10. The rotary encoder of claim 2, wherein said linearly-driven type component comprises a self-resetting type push switch.

11. The rotary encoder of claim 2, wherein:

said rotor has a plurality of ditches and ridges formed circularly along a peripheral surface thereof at substantially the same angle pitch with said comb-tooth shaped movable contacts; and said stationary body has a click spring, of which a dowel at a tip of a spring pillar is pressed resiliently against said ditches and ridges.

12. The rotary encoder of claim 2, wherein:

two out of said plurality of flexible contacts make resilient contact with said comb-tooth shaped movable contacts on the peripheral surface of said rotor; and contacting points between said two flexible contacts and said comb-tooth shaped movable contacts are shifted with respect to each other in a direction of rotation.

13. The rotary encoder of claim 3, wherein said linearly-driven type component comprises a self-resetting type push switch.

14. The rotary encoder of claim 3, wherein:

said rotor has a plurality of ditches and ridges formed circularly along a peripheral surface thereof at substantially the same angle pitch with said comb-tooth shaped movable contacts; and said stationary body has a click spring, of which a dowel at a tip of a spring pillar is pressed resiliently against said ditches and ridges.

15. The rotary encoder of claim 3, wherein:

two out of said plurality of flexible contacts make resilient contact with said comb-tooth shaped movable contacts on the peripheral surface of said rotor; and contacting points between said two flexible contacts and said comb-tooth shaped movable contacts are shifted with respect to each other in a direction of rotation.

16. The rotary encoder of claim 4, wherein said linearly-driven type component comprises a self-resetting type push switch.

17. The rotary encoder of claim 4, wherein:

said rotor has a plurality of ditches and ridges formed circularly along a peripheral surface thereof at substantially the same angle pitch with said comb-tooth shaped movable contacts; and said stationary body has a click spring, of which a dowel at a tip of a spring pillar is pressed resiliently against said ditches and ridges.

18. The rotary encoder of claim 4, wherein:

two out of said plurality of flexible contacts make resilient contact with said comb-tooth shaped movable contacts on the peripheral surface of said rotor; and contacting points between said two flexible contacts and said comb-tooth shaped movable contacts are shifted with respect to each other in a direction of rotation.

19. The rotary encoder of claim 12, wherein said two flexible contacts are arranged in a manner that said two flexible contacts remain in an OFF position on said comb-tooth shaped movable contacts, when said dowel at the tip end of said spring pillar rests in a ditch among said circularly formed plurality of ditches and ridges on the peripheral surface of said rotor.

20. The rotary encoder of claim 15, wherein said two flexible contacts are arranged in a manner that said two flexible contacts remain in an OFF position on said comb-tooth shaped movable contacts, when said dowel at the tip end of said spring pillar rests in a ditch among said circularly formed plurality of ditches and ridges on the peripheral surface of said rotor.

21. The rotary encoder of claim 18, wherein said two flexible contacts are arranged in a manner that said two flexible contacts remain in an OFF position on said comb-tooth shaped movable contacts, when said dowel at the tip end of said spring pillar rests in a ditch among said circularly formed plurality of ditches and ridges on the peripheral surface of said rotor.

22. The rotary encoder of claim 2, wherein said plurality of flexible contacts are arranged to make resilient contact with said movable contacts on the periphery of said rotor at a surface substantially orthogonal to a mounting surface of said rotary encoder, said mounting surface being in parallel with an axis of rotation.

23. The rotary encoder of claim 3, wherein said plurality of flexible contacts are arranged to make resilient contact with said movable contacts on the periphery of said rotor at a surface substantially orthogonal to a mounting surface of said rotary encoder, said mounting surface being in parallel with an axis of rotation.

24. The rotary encoder of claim 4, wherein said plurality of flexible contacts are arranged to make resilient contact with said movable contacts on the periphery of said rotor at a surface substantially orthogonal to a mounting surface of said rotary encoder, said mounting surface being in parallel with an axis of rotation.

* * * * *

UNITED STATES PATENT AND TRADEMARK OFFICE

CERTIFICATE OF CORRECTION

PATENT NO. : 6,194,673 B1
DATED : February 27, 2001
INVENTOR(S) : Sato et al.

It is certified that error appears in the above-identified patent and that said Letters Patent is hereby corrected as shown below:

Column 10,
Line 31, "whit" should read -- with --.

Signed and Sealed this

Nineteenth Day of March, 2002

*Attest:*

*Attesting Officer*

JAMES E. ROGAN
*Director of the United States Patent and Trademark Office*